United States Patent [19]

Burford

[11] 4,398,379

[45] Aug. 16, 1983

[54] TAB ATTACHMENT DEVICE

[76] Inventor: Charles E. Burford, P.O. Box 714, Maysville, Okla. 73057

[21] Appl. No.: 242,443

[22] Filed: Mar. 11, 1981

[51] Int. Cl.[3] ..... B65B 51/08; B65B 57/04

[52] U.S. Cl. ..... 53/77; 53/53; 53/138 A; 53/76

[58] Field of Search ..... 53/77, 138 A, 583, 53, 53/76

[56] References Cited

U.S. PATENT DOCUMENTS

| | | | |
|---|---|---|---|
| 2,879,636 | 3/1959 | Zuercher | 53/53 |
| 3,099,116 | 6/1963 | Platt, Jr. | 53/138 A |
| 3,163,969 | 1/1965 | Irwin | 53/138 A |
| 3,864,894 | 2/1975 | Sheetz | 53/77 |
| 3,919,829 | 11/1975 | Burford | 53/583 X |
| 3,983,681 | 10/1976 | Britt | 53/583 X |

FOREIGN PATENT DOCUMENTS

| | | | |
|---|---|---|---|
| 404293 | 1/1967 | Australia | 53/583 |
| 18204 | 10/1980 | European Pat. Off. | 53/138 A |

*Primary Examiner*—John Sipos

*Attorney, Agent, or Firm*—Gerald G. Crutsinger; John F. Booth; Monty L. Ross

[57] ABSTRACT

A device for attaching a tab with a central opening and bag receiving passage formed therein in which is gathered the neck of a flexible bag comprising: conveyor means to receive and flatten a portion of the bag adjacent the open end thereof and guide the flattened neck of the bag into the bag receiving passage and gather the bag neck in the tab; a tab strip feed mechanism and means severing each tab singly from the tab strip and positioning and bracing the tab to receive the bag neck; means detecting the completed passage of the bag and in response thereto releasing said tab and bag gathered therein prior to positioning another tab to receive a bag neck; means responsive to the reception of a product thickened bag neck in said conveyor means to cause said tab support means to release said tab prior to detection of completed passage of said bag. Also included is means to hold the passage of said tab open for the reception of a bag.

3 Claims, 9 Drawing Figures

TAB ATTACHMENT DEVICE

BACKGROUND OF INVENTION

A variety of methods for closing and sealing flexible plastic bags in which bakery products have been devised heretofore. U.S. Pat. No. 3,919,829 discloses a packaging device wherein a wire tie is twisted around the open end of a bag for closing and sealing the bag. The following U.S. patents disclose bag closing apparatus devised to attach a flat flexible rectangular shaped clip having a central opening and a slit communicating therewith around a neck adjacent the open end of the bag:

U.S. Pat. Nos. 3,099,116; 3,163,972; 3,579,955; 3,621,632; 3,910,811; and 4,171,602.

Devices heretofore devised for closing flexible plastic bags have been unduly complicated and in some instances, the speed of application of the devices was limited by jamming of closure apparatus which resulted from the inability of the system to position the bag containing the packaged product and the closure element in a required relationship for completing closing a bag and dispensing the bag. Malfunctions resulted when the product for some reason extended into the area to be closed, for example, if a piece of bread extended into the area to be closed, the bulky nature of the neck of the bag having the piece of bread extending thereinto in many instances could not be handled by the closure apparatus.

Devices heretofore devised have encountered difficulty in positively feeding clips to a precisely controlled position for attachment to a bag.

SUMMARY OF INVENTION

The tab attachment device disclosed herein includes improved apparatus for feeding and positioning a flexible tab in the path along which the open neck of a bag is moved. The device includes gathering apparatus for flattening the neck of a bag and moving the flattened neck of a bag into a tab opening for gathering the neck of the bag and attaching the tab around the gathered neck.

As the tab is positioned in the path of the neck of the bag, legs of the tab are deflected to increase the width of the slit through which the bag is moved into the central opening in the tab. A new and improved escapement mechanism is provided for interrupting a cycle of operation if a bulky item is inadvertently delivered to the tab attachment device so that the bulky item will be automatically discharged from the tab attachment device without necessitating any cessation of movement of conveyors which deliver the product to the tab attachment device.

The tab is separated from a continuous strip of tabs and positively held in a precise bag receiving position.

A cycle of operation of the device is initiated by sensing the position of the leading edge of the flattened neck of a bag to release a primary clutch stop and by sensing the position of the trailing edge of the bag, a secondary clutch stop is released simultaneously returning the primary clutch stop to the primary position for dispensing the closed bag, severing a tab from a strip of tabs, and moving the severed tab to the bag receiving position, thus terminating the cycle of operation when the clutch returns to engagement with the primary clutch stop.

A primary object of the invention is to provide a tab attachment device which is capable of sensing the position of the leading and trailing edges of a bag for controlling a cycle of operation.

Another object of the invention is to provide an improved tab attachment device wherein a tab is severed from a strip of tabs, deflected for enlarging the entrance opening, and positively held in position to receive the neck of a bag.

A further object of the invention is to provide a tab attachment device particularly devised for ejecting bulky objects which are too large to be closed by the tab.

Another object is to provide a tab attachment device having an improved conveyor mechanism which is resiliently biased to engage the neck of a bag along an extended plane causing the bag to track parallel with the ungathered portion of the bag.

Another object is to provide a tab attachment device wherein a roll of tabs is supported such that additional rolls of tabs may be loaded from either side of a conveyor and the strip of tabs twisted to accommodate movement of products to either side of the tab attachment device.

Another object is to provide a tab attachment device having a tab guide track in which a groove is provided in the rear surface of the tab guide track to control the path of a tool for removing defective clips without damaging guide surfaces in the guide.

Other and further objects of the invention will become apparent upon referring to the detailed description hereinafter following and to the drawings annexed hereto.

DESCRIPTION OF DRAWING

Numeral references are employed to designate like parts throughout the various figures of the drawing, in which.

Numeral references are employed to designate like parts throughout the various figures of the drawing.

DESCRIPTION OF A PREFERRED EMBODIMENT

Figure 1:
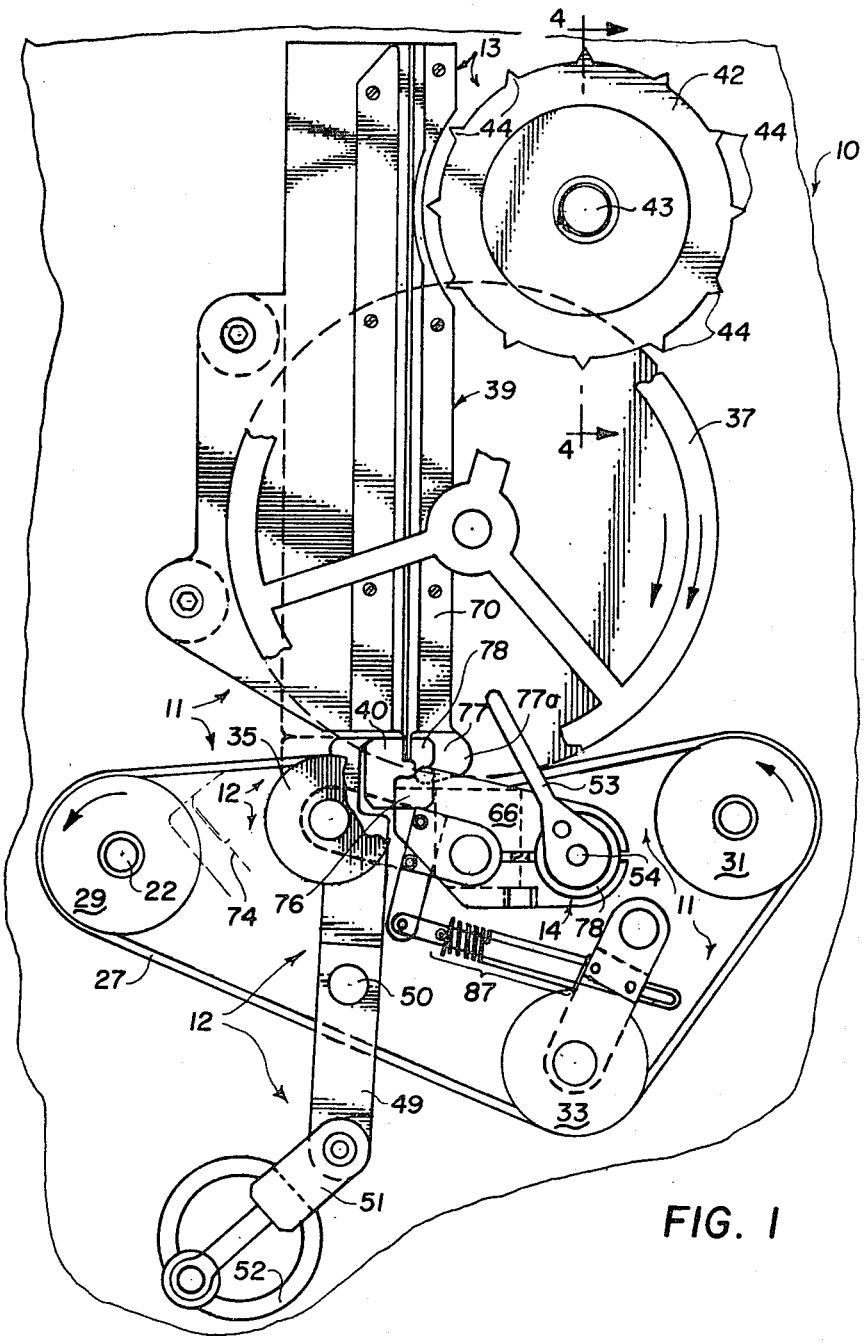
FIG. 1 is a partial front elevational view of the tab attachment device.

As will be hereinafter more fully explained, the tab attachment device 10 is particularly adapted for attaching a tab, having a central opening and a bag receiving passage formed therein, about a gathered neck of a flexible bag. A conveyor means 11 is provided to flatten a portion of a bag adjacent the open end of the bag, to form a flattened neck and to move the flattened neck of the bag along a path across which the tab is supported. As illustrated in FIG. 1, the upper edge 78 of a tab 40 is secured in the lower end 77 of a guide track while the lower edge 76 of the tab is supported in a tab support shoe 66 pivotally secured to the frame of the device. A breaker arm 49 of tab separating mechanism 12 engages the rear edge of tab 40 for severing the tab 40 from a strip of tabs, moving the severed tab into the support shoe and holding the tab in position until the clip and the gathered neck of the bag is ejected from the tab attachment device.

In FIGS. 1-4 are shown the main elements of the tab attachment device 10 of the present invention. These include the belt drive mechanism at 11, the tab separating mechanism 12, the tab advance and guide mechanism 13 and the "feed complete" detector mechanism 14 as well as the primary drive system 15.

Primary drive for the device of the present invention is an electric motor 16. Drive wheel 17 mounted on the shaft 18 of motor 16, drives belt 17*a* and pulley 17*b* on shaft 26*a* which imparts through drive belt 19 rotational motion to drive and idler pulleys 20 and 21 on shafts 22 and 23, respectively, to input drive pulley 24 and shaft of clutch mechanism 25 and to drive pulley 26 keyed to shaft 26*a*.

The belt feed mechanism 11 comprises a pair of closed feed belts 27 and 28 of neoprene or other similar material with suitable elastic and "gripping" properties. Feed belts 27 and 28 are threaded around and travel on drive pulleys 29 and 30, idler pulleys 31 and 32, tension pulleys 33 and 34 and pressure pad pulleys 35 and 36. A pair of feed wheels 37 and 38 ride on top of the belts 27 and 28 in the tab attachment region forcing them into pressure contact with pulleys 35 and 36.

The tab advance and guide mechanism 13 comprises a tab guide track or chute 39 through which a supply of closure tabs in the form of a continuous strip of tabs interconnected by small uncut regions is fed to the tab application region. A tab 40 already separated from the tab strip is shown in position ready for application to a product bag for closure. A suitable form of tab strip for use in this invention is disclosed in U.S. Pat. No. 4,215,606 issued Aug. 5, 1980, to the assignee of the present invention. The tab strip is pulled from a supply reel 41 and fed through guide 39 by star gear wheel 42 mounted on and keyed to shaft 43. Star gear wheel 42 has spaced around its periphery projections 44 which mate with the notches in the throat openings of the tabs of the tab strip. Periodic rotation of the star gear wheel 42 through a partial revolution, of for example, about 30°, is produced by an intermittent drive mechanism keyed to the other end of shaft 43 and comprising a notch wheel 45 driven by pittman arm 46 through cross lever 60 through spring latch levers 47 and 48.

Figure 4:
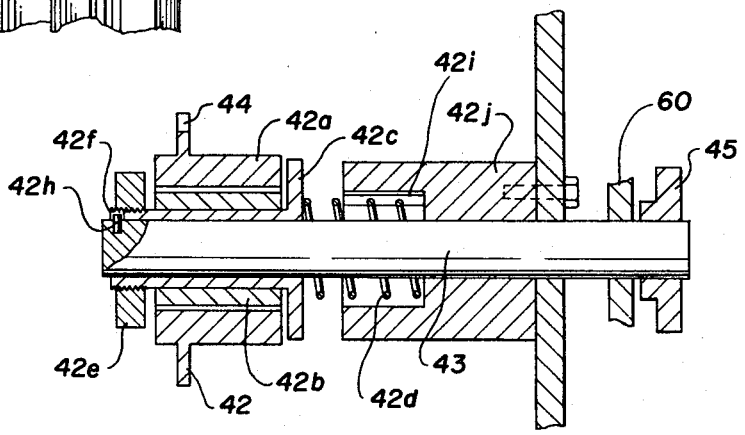
FIG. 4 is a cross-sectional view taken along line 4—4 of FIG. 1.

As illustrated in FIG. 4, star gear wheel 42 is formed on a hub 42*a* through which a "Sprag" bearing 42*b* extends. The "Sprag" bearing 42*b* is on a sleeve 42*c* urged outwardly by spring 42*d*. The outer end of sleeve 42*c* is threaded into disc 42*e* and has a slot 42*f* into which pin 42*h* on shaft 43 extends. Spring 42*d* extends into bore 42*i* in bearing 42*j*. When disc 42*e* is loosened, "Sprag" bearing 42*b* permits rotation of star wheel 42 on shaft 43 relative to notch wheel 45 for positioning a tab 40 in strip of tabs in the proper position relative to breaker bar 49 and tab support shoe 66. When disc 42*e* is tightened the "Sprag" bearing 42*b* is locked to maintain wheels 44 and 45 in the established relationship. For loading tabs into guide chute 39, disc 42*e* and sleeve 42*c* can be pushed inwardly to disengage pin 42*h* from slot 42*f* so that star wheel 42 can be rotated freely.

The tab separator mechanism 12 comprises breaker arm 49 pivoted about shaft 50 by breaker link 51 which is cammed by its attachment to breaker drive wheel 52 as shown. The upper portion of breaker arm 49 is shaped to contact the rear slot and rear edge of a tab on the strip and sever it from the strip while moving it into position to receive a product bag end. Braker drive wheel 52 is keyed to shaft 84 for rotation when clutch 25 is engaged.

The "feed complete" detector comprises trip lever 53 mounted on and keyed to trip axle 54 which at its other end is coupled to trip arm bracket 55 which in turn is connected for operation of trip rods 56 and 57 to produce engagement of clutch 25. The trip lever 53 is positioned between feed belts 27 and 28 and is biased into the angled upright position shown by spring member 58 acting through trip arm bracket 55.

Figure 2:
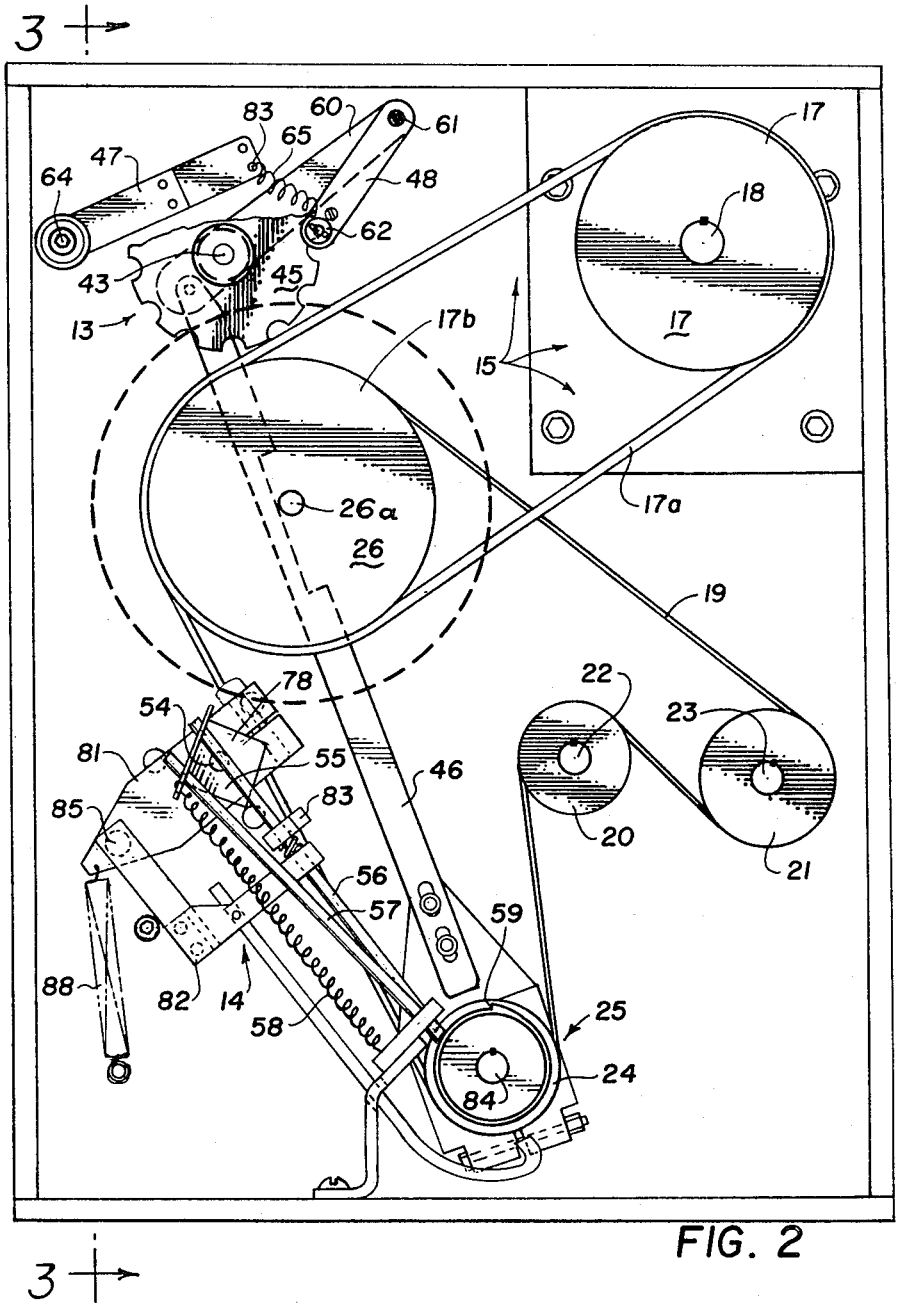
FIG. 2 is a rear elevational view.
Figure 3:
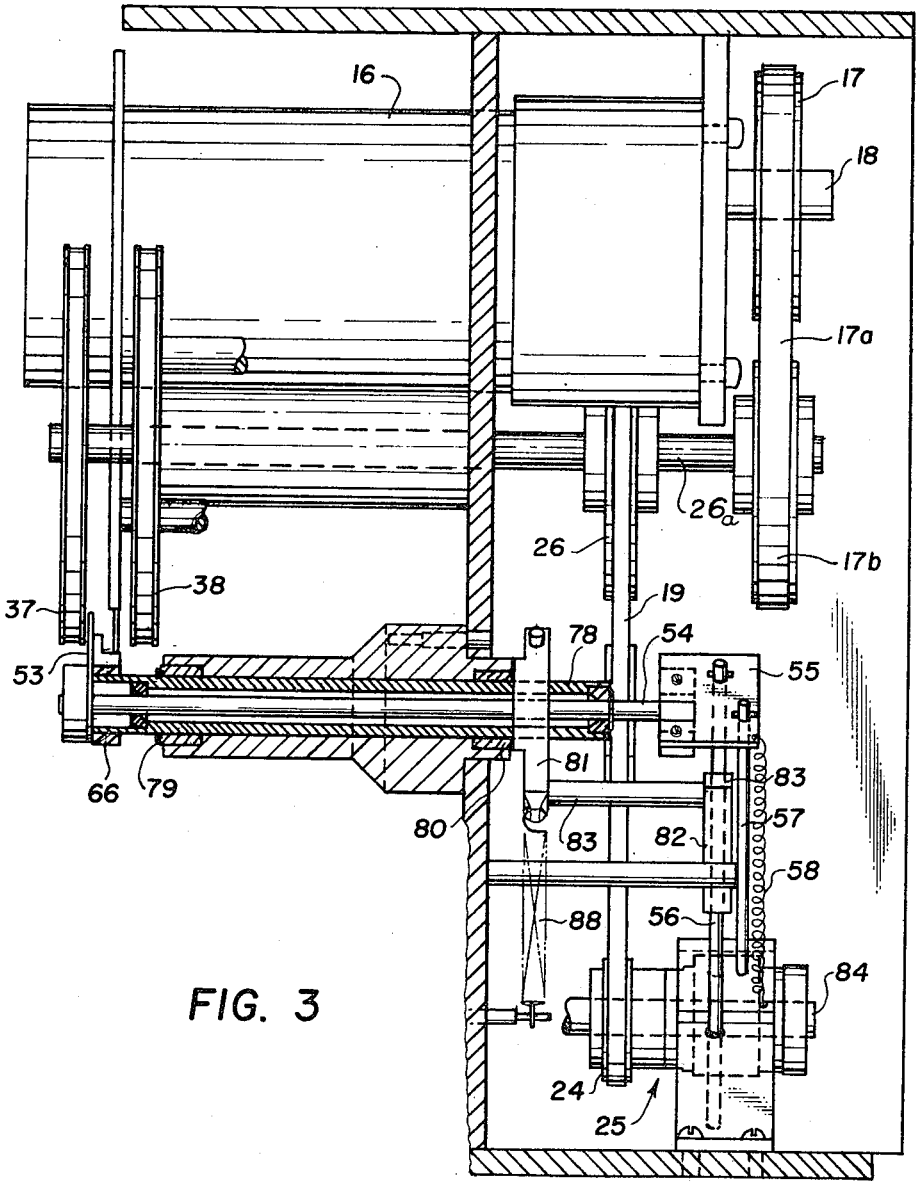
FIG. 3 is a cross-sectional view taken along line 3—3 of FIG. 2.
Figure 5:
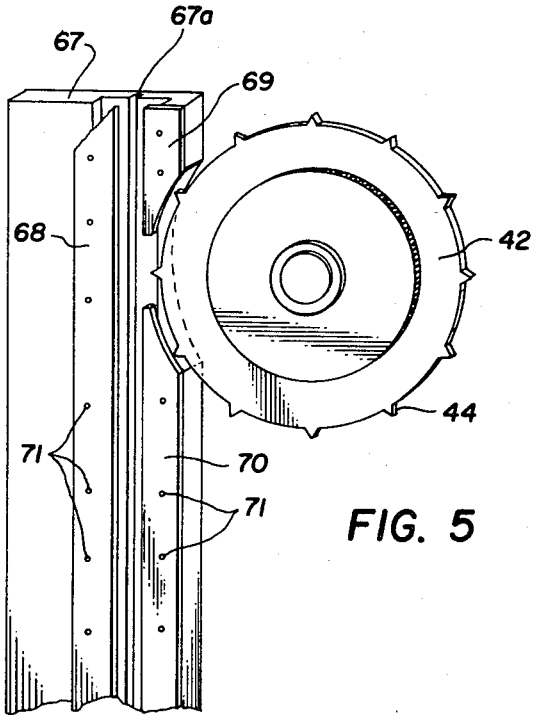
FIG. 5 is a fragmentary perspective view of the tab feeder.

For a description of the operation of the present invention assume that a closure tab 40 has been severed from the tape and moved and held in position just slightly to the right of the position shown in FIG. 1 by the upper end of breaker arm 49. Breaker arm 49 bears against and supports the back edge of tab 40. In such a position the tab is opened slightly by mechanism to be explained subsequently and is ready to receive the open end of a product bag. As bagged product is moved along from right to left, as for example, by a conveyor belt with the open end of the bag facing into the drawing, the leading edge of the bag end is swept into contact with feed belts 27 and 28 and then between feed belts 27 and 28 and feed wheels 37 and 38. As the bag is fed toward the opening of tab 40 its leading edge forces trip lever 53 to a more horizontal position where it remains until the trailing edge of the bag has passed. Since the back edge of the tab opening prevents exit of the bag and the feed belts and wheels continue to move the rest of the bag towards the tab, the open end of the bag gathers in the tab and is compressed into a tight and effective closure by the tab 40. The movement of trip lever 53 by the passing of the leading edge of the product bag is transmitted to trip arm bracket 55 as clockwise motion (as seen in FIG. 2) which lifts trip rod 57 and lowers trip rod 56. Output rotation of the wrap spring single revolution clutch 25 has been prevented by the blocking action of trip rod 57 bearing against cam face 59 on the clutch output member. The lifting of trip rod 57 allows the clutch output member to rotate by just enough to bring the cam face 59 into contact with lowered trip rod 56. Thus, output from clutch 25 is still prevented while trip lever 53 is held in a horizontal position by the presence of a product bag. However, as the trailing edge of the product bag passes over trip lever 53 and into the closure tab, the trip lever is released and is pulled back into its more vertical position by spring member 58. Return of trip lever 53 to its original position produces a counterclockwise rotation of trip arm bracket 55 through trip axle 54 and raises trip rod 56 at the same time lowering trip rod 57. Since trip rod 57 is lowered after the passing of cam face 59, clutch 25 is "engaged" and produces output until cam face 59 again comes in contact with and is stopped by trip rod 57. This assures that the clutch will be engaged for only a single rotation.

A single revolution of clutch output is all that is needed to put the closure tab operation device into condition to receive the next product bag for closing. It should be noted at this point that further operation of the machine after presentation to it of a product bag for closure is not a timed response, i.e., does not occur at a preset time after arrival of the product bag as in many prior art mechanisms. Further operation of the present machine occurs only after it has been determined that the trailing edge of the bag has passed to the tab. As a result, no timing reset or adjustment is required in the present machine when product bags of different sizes are used. The entire bag must be past the detector before further operations can continue.

Returning now to the actions which take place after clutch 25 has been engaged for output, two distinct actions go on simultaneously. In the first, breaker drive wheel 52 which is keyed to the output shaft 84 of clutch 25 is rotated through one revolution. By the first half revolution of clutch output breaker link 51 is cammed to move breaker arm 49 to the position shown in dashed lines in FIG. 1, thus allowing the product bag now closed by the closure tab to be moved out of the machine by further action belts 27 and 28 and feed wheels 37 and 38. The last one-half revolution of the braker wheel 52 causes breaker arm 49 to move back to its original position.

In the meantime, however, the one revolution clutch output has activated pittman arm 46 to produce a one notch movement of notch wheel 45. The action is as follows: Pittman arm 46 is moved upward by its connection to an offset crank on the output shaft of clutch 25. The arm movement activates cross lever 60 which is pivoted for movement about shaft 43. Thus, as the pittman arm rises, latch lever 48, connected through coupling pin 61 to cross lever 60, is urged downward driving notch pin 62 more firmly into the notch of notch wheel 45 and causing the wheel to turn. The notch pin 63 of notch lever 47 which is pivoted about pin 64 is forced out of its notch against the force of spring 65. Notch pin 63 rides the rim of notch wheel 45 until it is forced into the next notch of wheel 45 by spring 65. At this point the pittman arm 46 begins a reverse motion pulling cross lever 60 and its coupling pin in a counterclockwise direction around the pivot point of shaft 43. This action causes notch pin 62 to be pulled out of the drive notch and back along the rim of notch wheel 45 until the pull of spring 65 causes it to seat in the next notch of wheel 45. At this point clutch 25 has completed its single output revolution and the entire mechanism is reset for the next cycle.

Rotation of notch wheel 45 produces corresponding rotation of the star drive gear 42 thereby moving the tab strip through the guide 39 and placing the next tab of the strip in position of tab 40.

By way of review, the release of trip lever 53 by the passing of the product bag trailing edge creates a one revolution output from clutch 25. During the first one-half of this revolution breaker arm 49 is moved out of its tab holding position allowing the closed product bag to be moved out of machine by feed belts 27 and 28. Also, the tab strip is advanced one tab length by star drive gear 42 and a new tab positioned as illustrated by tab 40. During the second half of a single rotation output of clutch 25 breaker arm 49 pivoted clockwise to strike tab 40 and break it, that is, remove it from the tab strip and move it into position to receive the next product bag end.

It has been found that in the final positioning of tab 40 to receive a product bag end it is advantageous to bias the tab slightly open. The means for accomplishing this is shown in FIGS. 1 and 5–9. Shown in FIG. 1 is the tab guide chute 39, the tab stop shoe 66, and breaker arm 49. Tab guide chute 39 comprises a channel back plate 67, having a clean-out groove **67*a* formed therein, to which are attached front plates 68, 69 and 70 such as by screws 71. The opening between plates 69 and 70 allows the star gear to drive the tab strip to indexed stops through its intermittent movement as already discussed. With the tab strip positioned as illustrated, by the indexed rotation of star gear wheel 42 during the first half rotation of clutch 25 output, the second half rotation of clutch output brings breaker arm 49 into contact with the bottom tab 40. Breaker arm 49 is provided with a wedge shaped tip 72 designed to strike the tab strip at the notch 73 on the rear of the strip thus forcing tab 40 away from the rest of the strip and rupturing the small holding members between the tabs and freeing tab 40 from the rest of the strip. Breaker arm 49 is also provided with a vertically running groove 74 designed to receive and cradle the back edge of tab 40 while moving the tab 40 forward from the "break-away" position. Tab 40 is driven a short distance forward into slot 75 of tab stop shoe 66, illustrated in FIGS. 7–9, until the front edge of the lower lip 76 of tab 40 strikes the rear wall of the slot 75. The beveled back side wall 99 of slot 75 guides the lower lip 76 of the tab into close contact with the front side wall of slot 75** where it is firmly held.

Plate 70 of guide chute 39 is provided with an extension 77 which reaches to the level of the upper lip 78 of tab 40 after it has been severed from the strip. The forward edge **77*a* of extension 77 is bent inward toward the back channel 67 of chute 39 so that as tab 40 moves into slot 75 its upper lip 78 strikes the front portion of extension 77 and is forced slightly out of alignment with the lower lip 76 which is held firmly in slot 75 by tab stop chute 66. Thus, the "throat" of tab 40** is opened slightly but by enough to materially assist in the insertion of the product bag end.

The above described mechanism provides several advantageous features in the present invention not found in prior art systems. First of all, each tab is completely severed and separated from the tab strip before insertion of the bag end is initiated. Secondly, the tab is held partially open for easier and surer insertion of the bag end. And thirdly, braker arm 49, slot 74 provides solid backing and reinforcement of the tab during insertion of the bag end in order to prevent possible breakage or collapse of the tab.

An anti-jam feature is provided in the present invention to prevent the necessity of shutting down operations should some of the product become misplaced in the bag prior to the closure operation and be lodged inadvertently in that part of the bag fed to the closure mechanism. Such a misplacement of product will often jam prior art machines when the presence of the product blocks proper application of the tab. Further, the anti-jam feature causes the restricted area where the bag neck is gathered to open if a human hand moves between the drive wheels and the tab support shoe.

In the present invention the tab support shoe 66 is mounted on hollow shaft 78 concentric with and providing bearing mounting for trip axle 54; shaft 78 being rotatably mounted to the machine frame by bearings 79 and 80. Mounted on the other end of hollow shaft 78 is jam-release arm 81. Spring 88 connected between jam release arm 81 and the machine frame biases tab stop shoe 66 into operating position. Connected to jam-release arm 81 through pin 85 is a release lever 82 which is arranged to raise trip rod 56 through action against rod stop 83. Pressure contact pulleys 35 and 36 are mounted on brackets 84 and 85 each individually pivotally mounted on pin 86 which is affixed to an extension of tab stop shoe 66. The spring and bracket arrangement designated 87 urges pulleys 33 and 35 against drive belt 27 while a similar arrangement acts on pulleys 34 and 36.

Without the anti-jam feature of the present invention, if a bag with product misplaced and occupying the closure area of the bag enters the tab attachment region, spring loaded pulleys and belts might be able to accommodate the extra bulk but since the bag is precluded from being fed completely into the tab, the trip lever 53 would not be released. As a result breaker arm 49 will remain in the upright position blocking exit from the machine of the faultily closed bag and effectively jamming the machine.

The anti-jamming feature acts as follows. As the potentially jamming bag enters the machine, trip lever 53 is depressed thus cocking clutch release mechanism, i.e., trip rod 56 is lowered and trip rod 57 is raised. Thereafter, the extra bulk of product in the bag closure area wedges between the tab support shoe 66 and feed wheels 37 and 38 forcing tab stop shoe 66 down in a rotational movement about its pivot point of axle 54. Such movement is transmitted through hollow shaft 78 to move jam release arm 81 in a clockwise rotation (looking at FIG. 2). This action moves release lever 82 against rod stop 83 to raise trip rod 56. In this manner, clutch 25 is engaged even though trip lever 53 cannot be released. This initiation of the clutch cycle moves breaker arm 49 out of its blocking position, allows the faultily closed bag to pass through the machine without jam-up, and, at the same time, resets the machine to properly receive the next bag for closure. Thus, machine operation need not be stopped to remove the potentially jamming bag.

A secondary trip rod **56*a* is secured to release lever 82 and has a lower end 56*b* positioned to engage cam face 59 to disengage clutch 25 when the breaker bar 49 reaches the position shown in dashed outline in FIG. 1. This assures that breaker arm 49 will not move forward to obstruct removal of a bulky object until arm 53** is released.

Figure 6:
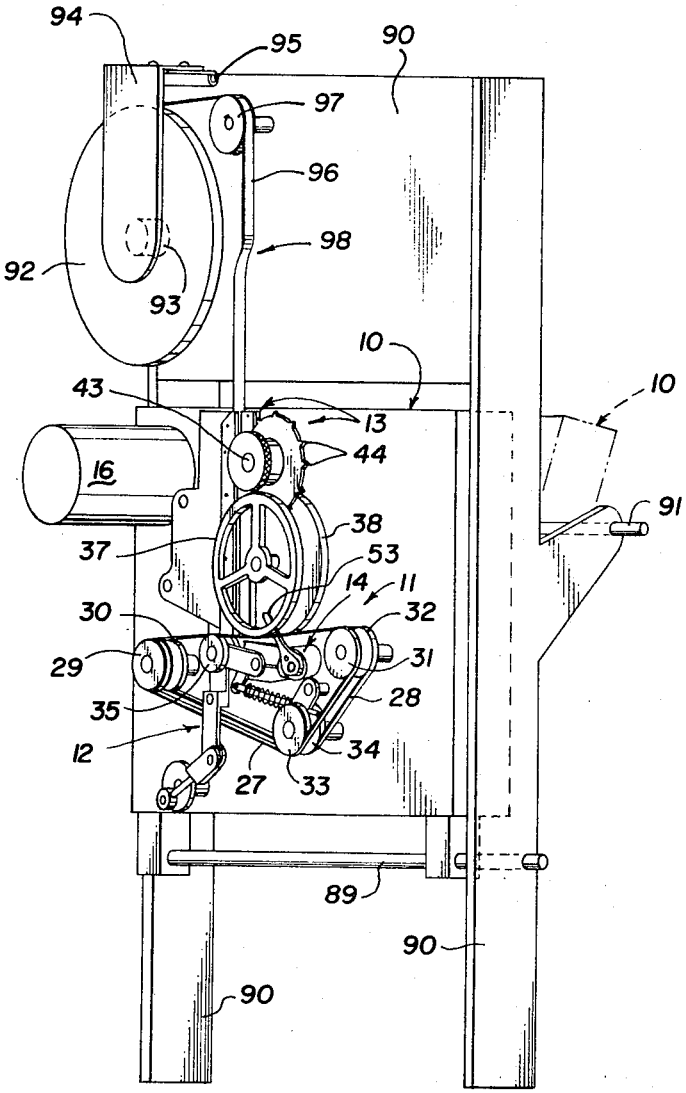
FIG. 6 is a schematic perspective view of supporting structure.
Figure 9:
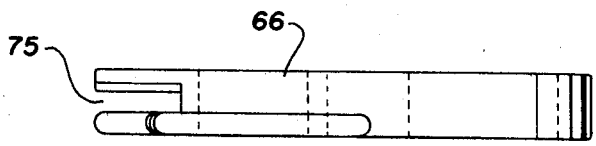
FIGS. 7, 8 and 9 are front, end, and top views, respectively, of a tab support shoe.
Figure 8:
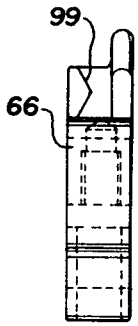
Figure 7:
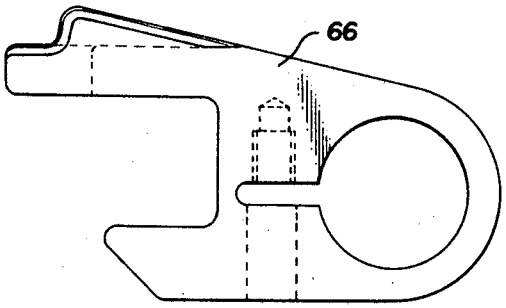

As illustrated in FIG. 6, the tab attachment device 10 is pivotally secured to a hinge bar 89 supported by a frame 90 having a stop 91 extending across the rear end thereof. This permits pivoting the attachment device 10 to the position shown in dashed outline for cleaning and maintenance.

The roll 92 of tab strip is vertically mounted on a shaft 93 secured to a plate 94 which is hinged to the frame 90 by hinge 95. The strip 96 of tabs extending around a pulley 97 is twisted, as shown at 98 so that the entrance opening in the tabs may be positioned to extend to either the right or to the left as viewed in FIG. 6. Further, loading of a new roll of tabs can be accomplished by an operator reaching over a conveyor belt in front of tab applicator device 10 and carrying product filled bags to the machine.

Having described my invention, I claim:

1. A device for attaching a tab having a central opening and a bag receiving passage formed therein, about the gathered neck of a flexible bag, said device comprising: conveyor means to flatten a portion of the bag adjacent the open end of the bag, to form a flattened bag neck, and to move the flattened bag along a path; tab support means movably mounted adjacent said path to support a tab such that the conveyor means moves the flattened neck into a bag receiving passage in the tab; tab positioning means movably mounted in said bag path urging said tab into engagement with said tab support means; and anti-jam means operably connected between said tab positioning means and said tab support means for moving said positioning means out of said path responsive to movement of said support means away from said path on its engagement with a neck which is too large to enter the bag receiving passage in the tab along said path .

2. The device of claim 1, further comprising a tab feed means including a guide track; and means to move a tab along said guide track, to said tab support means, the end of the track being formed to support one edge of a tab on a first side of the path while a second edge of the tab is guided to and held by said support means on a second side of the path.

3. The device of claim 2, wherein said anti-jam means comprises means resiliently urging said support means toward said path.

* * * * *